US007485167B2

(12) United States Patent
Kennedy

(10) Patent No.: US 7,485,167 B2
(45) Date of Patent: Feb. 3, 2009

(54) SHAKER MECHANISM FOR VACUUM CLEANER FILTER BAG

(75) Inventor: David Kennedy, Morristown, NJ (US)

(73) Assignee: Vac-U-Max, Belleville, NJ (US)

( * ) Notice: Subject to any disclaimer, the term of this patent is extended or adjusted under 35 U.S.C. 154(b) by 428 days.

(21) Appl. No.: 11/153,297

(22) Filed: Jun. 15, 2005

(65) Prior Publication Data

US 2006/0283158 A1 Dec. 21, 2006

(51) Int. Cl.
*F23J 1/02* (2006.01)
*A47L 7/00* (2006.01)

(52) U.S. Cl. ..... 55/385.1; 55/300; 55/304; 55/DIG. 3; 55/DIG. 8; 55/356; 55/357; 15/347; 15/352

(58) Field of Classification Search ..... 55/300, 55/304, 385.1, DIG. 3, DIG. 8, 356, 357; 15/347, 352

See application file for complete search history.

(56) References Cited

U.S. PATENT DOCUMENTS 946,535 A * 1/1910 Craver ..... 96/416
2,232,574 A 2/1941 Veevers
4,868,949 A 9/1989 Loveless
5,259,087 A 11/1993 Loveless
5,704,956 A 1/1998 Loveless
7,282,074 B1 * 10/2007 Witter ..... 55/300

FOREIGN PATENT DOCUMENTS

GB 2 219 524 A 12/1989

OTHER PUBLICATIONS

International Search Report from the European Patent Office dated Dec. 7, 2005.

* cited by examiner

*Primary Examiner*—Jason M Greene
*Assistant Examiner*—Minh-Chau T Pham
(74) *Attorney, Agent, or Firm*—Norris, McLaughlin & Marcus; Christa Hildebrand

(57) ABSTRACT

A manually moveable filter shaker for a drum-style vacuum cleaner with a drum lid and a filter bag mounted below the drum lid. The filter shaker includes a shaker handle operable from outside of the drum lid and extending through an elastically deformable pressure-tight through-hole in the drum lid and into the filter bag having a contoured bottom. The shaker handle extends to the bottom of the filter bag. Guide template control the manual movement of the shaker handles such that the shaker handle shakes the filter bag loosening accumulated debris.

10 Claims, 3 Drawing Sheets

SHAKER MECHANISM FOR VACUUM CLEANER FILTER BAG

BACKGROUND OF THE INVENTION

The present invention relates to an improved industrial drum-style vacuum cleaner. More particularly, the invention relates to a filter shaking mechanism for the industrial drum-style vacuum cleaner that extends the vacuuming time before maintenance of the filter has to be performed.

Industrial drum-style vacuum cleaners are very common in manufacturing and processing plants, as well as in workshops of many industries and businesses. Typically, the drum-style vacuum cleaner includes a steel drum with a removable top or lid. The lid accommodates a motor, placed on top of the lid, most likely, a carbon-brush type vacuum motor, such as a single or twin jet venturi suction motor. The debris/dust particles mixed into air that are suctioned up by the motor are separated from the air by a dust filter and the cleaned air escapes back into the environment, while the debris/dust particles are retained in the drum. The dust filter is clamped just below the motor to the bottom of the lid. The steel drum, most typically, is a 30 or a 55-gallon steel drum, rests on a dolly equipped with swivel casters, easily moveable to a cleanup site.

Depending on the environment in which the vacuum cleaner is used and the specific environmental considerations that need to be observed, different filters are utilized. Often, powder particles have a size between 5 to 10 microns. Filters, such as Teflon filters, were developed to capture and trap particles of 1 micron. However, such fine particles or even more common powdered materials that are vacuumed up from cleanup sites, accumulate on the filter and clog the filter material to such degree that the suction power is reduced, causing the motor(s) to overheat. The vacuuming has to be interrupted so that the filter can be changed. Interrupting the vacuuming process in order to clean or change the filter, is time consuming. Most often, the vacuum cleaner has to be removed from the clean-up site in order to reduce the amount of air bound dirt particles that are released upon opening of the drum. One method to provide a quick remedy for cleaning clogged filters is to equip the vacuum cleaner with a manual pulse-jet cleaning system which provides a quick blast of compressed air through the filter so that any accumulated material on the filter is dislodged. Although the speed and efficiency of the pulse-jet eliminates the need for the vacuum operator to stop working and manually clean or change the vacuum's filter, it is also rather costly to equip each model with a pulse-jet cleaning system.

SUMMARY OF THE INVENTION

It is, therefore an object of the present invention to provide an efficient device for manually cleaning accumulated particles off a filter of an industrial-style drum vacuum cleaner, without disassembling the entire vacuum drum.

It is another object of the invention to provide a cost effective, simple device which cleans the filter without greatly interrupting the operator's work.

Moreover, it is another object of the invention to accomplish the cleaning of the filter without moving the vacuum cleaner into a different area of the plant and away from the clean up site.

In addition, it is another object of the invention to clean the filter without dislodging the debris particles into the atmosphere, but instead, retaining the debris in the drum.

These and other objects of this invention will be evident when viewed in light of the drawings, detailed description, and appended claims.

These and other objects of this invention are achieved by providing a filter cleaning device for a drum-style vacuum cleaner having a lid with a motor, a dual motor or venture unit mounted on the top of the lid. Such vacuum cleaner models typically include a filter in form of a filter bag positioned under the lid, below the motor and in the air passageway so that the air with the debris and dust particles, which is suctioned up has to pass the filter before the filtered air is returned to the atmosphere. The filter bag extends into the drum and is clamped against a sealing ring to the lid for easy removal.

The filter shaking device is a mechanical filter bag shaker, accessible from the outside of the drum. The shaker extends through a pressure-tight through hole, into the filter bag which is mounted under the lid.

The operator of the vacuum cleaner activates the filter bag shaker from the outside by simply interrupting the vacuuming and by moving the shaker handle, positioned above the drum lid, back and forth. The handle is designed such that it extends into the bottom of the filter bag and upon moving the handle back and forth; the handle moves the bag also back and forth, thereby slightly crunching the bag at the end of each movement. Several back and forth movements provides shaking of the filter bag which causes a loosening of dust built up on the filter bag, and thereby avoiding dust built-up or "blinding" of the filter. Loosening the dust built-up prolongs the vacuuming time because the air flows more efficiently through the unclogged pores of the filter, which makes the cleaning up operation more efficient. There is no need to take the vacuum cleaner apart to change the filter.

More specifically, the filter bag shaking device comprises a shaker handle, extending out from the lid of the drum vacuum cleaner. The shaker handle further extends through an elastically deformable sealed opening through the lid and into the filter bag. The filter bag is held in place by an arm, which is fixed to the bottom of the lid. The open top of the filter bag is pressed against the lid and is sealingly covering an air port extending to the motor positioned on top of the lid. The filter bag may also be easily removed and exchanged. The shaker handle, after extending from the elastically deformable seal in the lid, is guided through a guide template, which controls the extent of the movement allowed for the shaker handle inside the filter bag. A shaker frame is arranged on the bottom of the shaker handle and is formed to fit approximately he contours of the filter bag. Once the operator notices a decline in efficiency of the vacuum cleaner, he/she turns off the vacuum and moves the shaker handle back and forth, perhaps repeating the movement several times, depending on the dust built up in the bag. The movement of the handle initiated outside, translates through the control of the guide templates into a back and forth movement of the frame. The back and forth motion causes a crunching of the filter bag and results into a removal of the dust built-up on the filter.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims

DESCRIPTION OF THE INVENTION

Figure 1A:
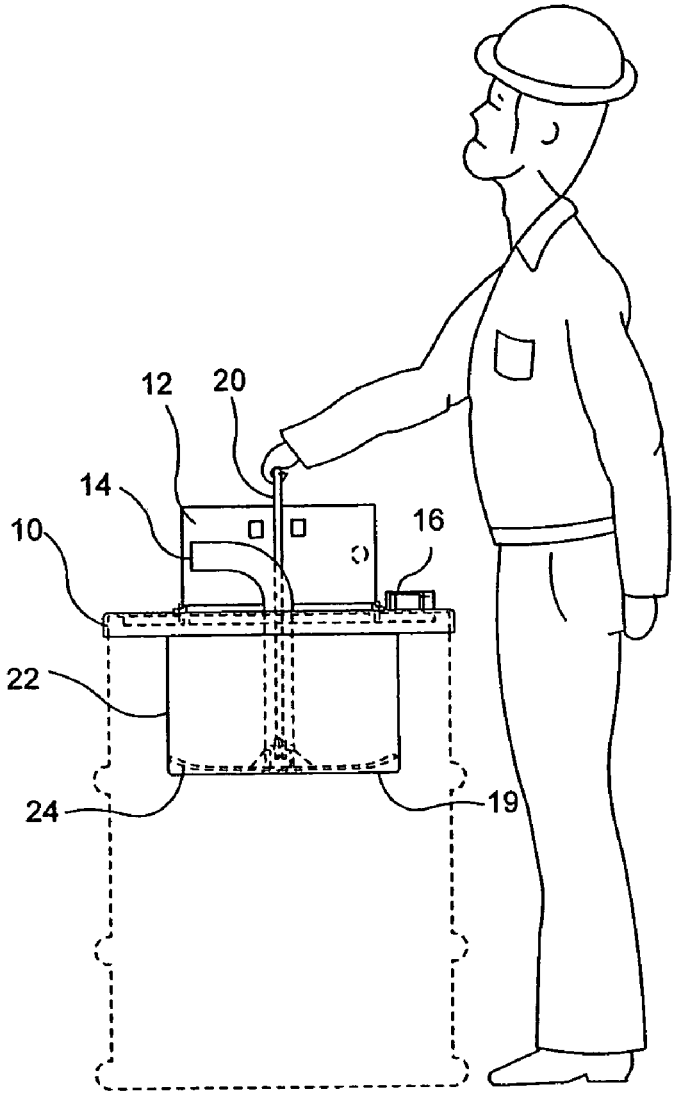
FIGS. 1A-C illustrate the overall design of the drum-style vacuum cleaner with a filter shaker device.
Figure 1B:
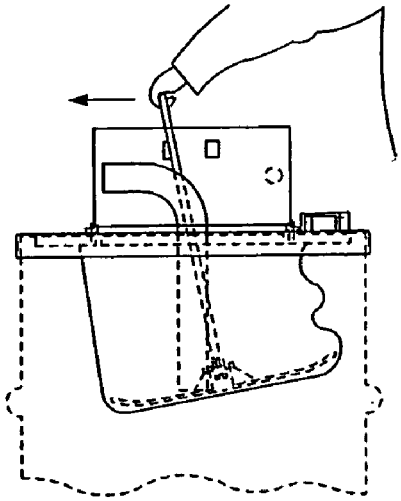
Figure 1C:
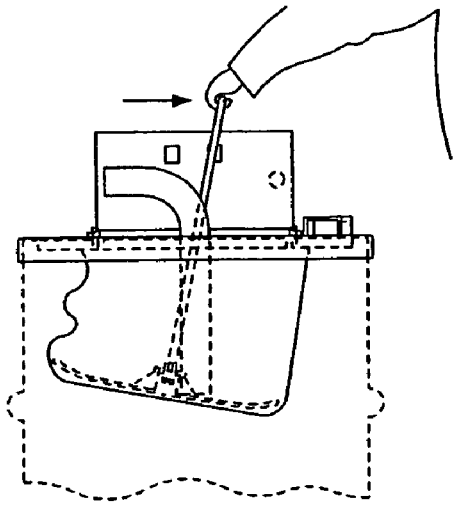

FIGS. 1A-C illustrates the overall appearance of the drum-style vacuum cleaner with a filter shaker device. An operator is shown moving the shaker handle from a neutral position in FIG. 1A to a forward and backward position in FIGS. 1B and 1C. FIG. 1A also shows the drum lid 10, positioned typically on an industrial 55 gallon steel drum. The depicted embodiment shows two vacuum motors 12 arranged on the top of the lid 10. It is understood that the filter shaker 20, 24 may be incorporated into a drum-style vacuum cleaner which is run by a vacuum motor(s) positioned away from the lid of the drum. FIG. 1A also shows a suction connection 14 and a handle 16 for manipulating the lid 10. The filter, in form of a filter bag 22 is mounted under the lid 10. The shaker handle 20 extends from above the lid 10, through an elastically deformable seal (FIG. 4) in the lid 10 to the bottom 19 of the filter bag 22. The shaker handle 20 terminates in a shaker frame 24 which is designed to conform to the contours of the bottom of the filter bag 22 and lightly touching the bottom 19 of the filter bag 22. As is seen in FIGS. 1B and 1C, upon moving the handle 20 forward (FIG. 1C) and backwards (FIG. 1B), the contoured frame 24 crunches the bag in either direction and thereby shakes off the accumulated debris that was lodged on the outside of the filter bag. Several shaking motions even dislodge dust particles entrapped in the pores of the filter material.

Figure 2:
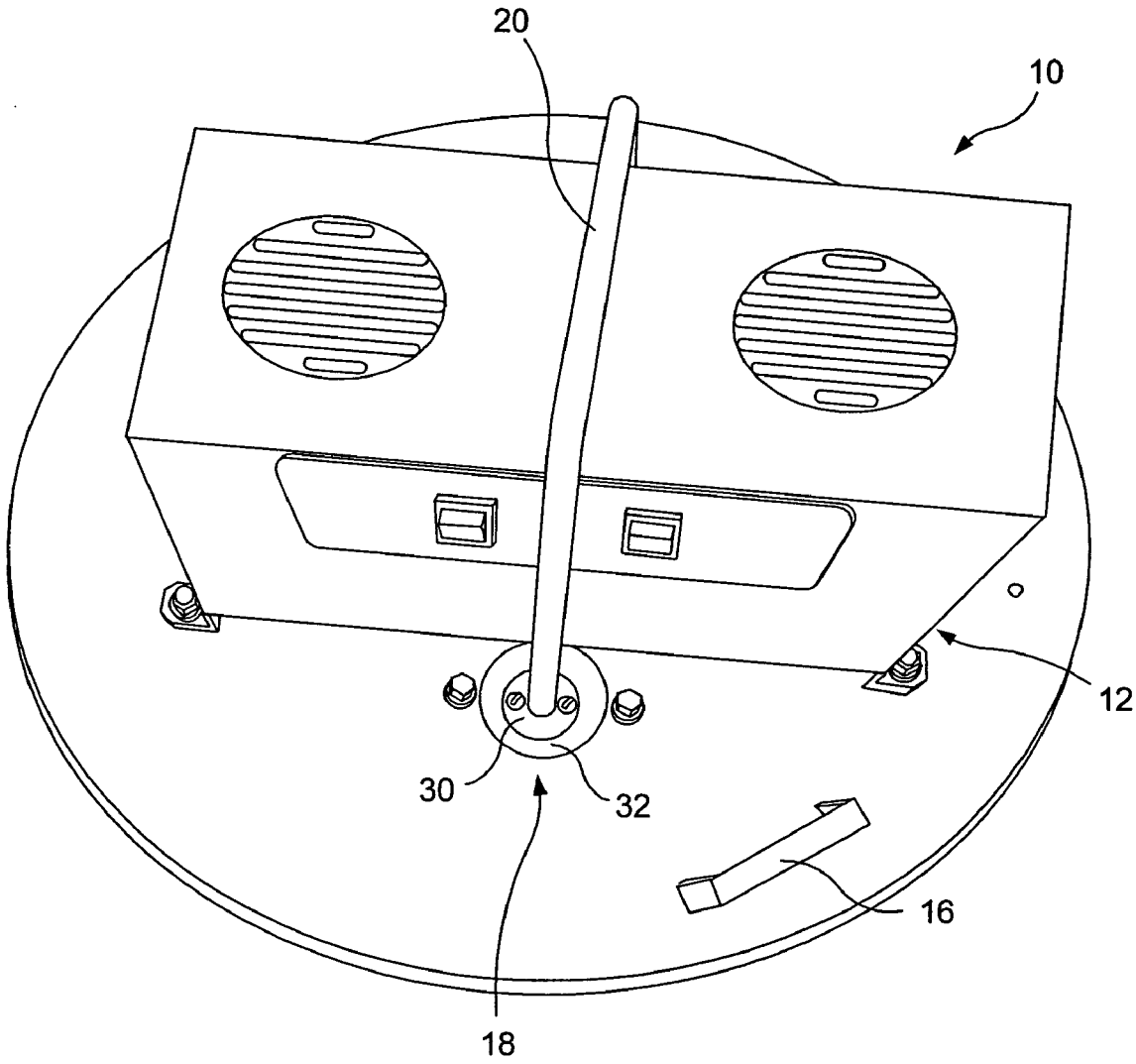
FIG. 2 is a perspective view of the lid of the drum-style vacuum cleaner covering a steel drum.
Figure 3:
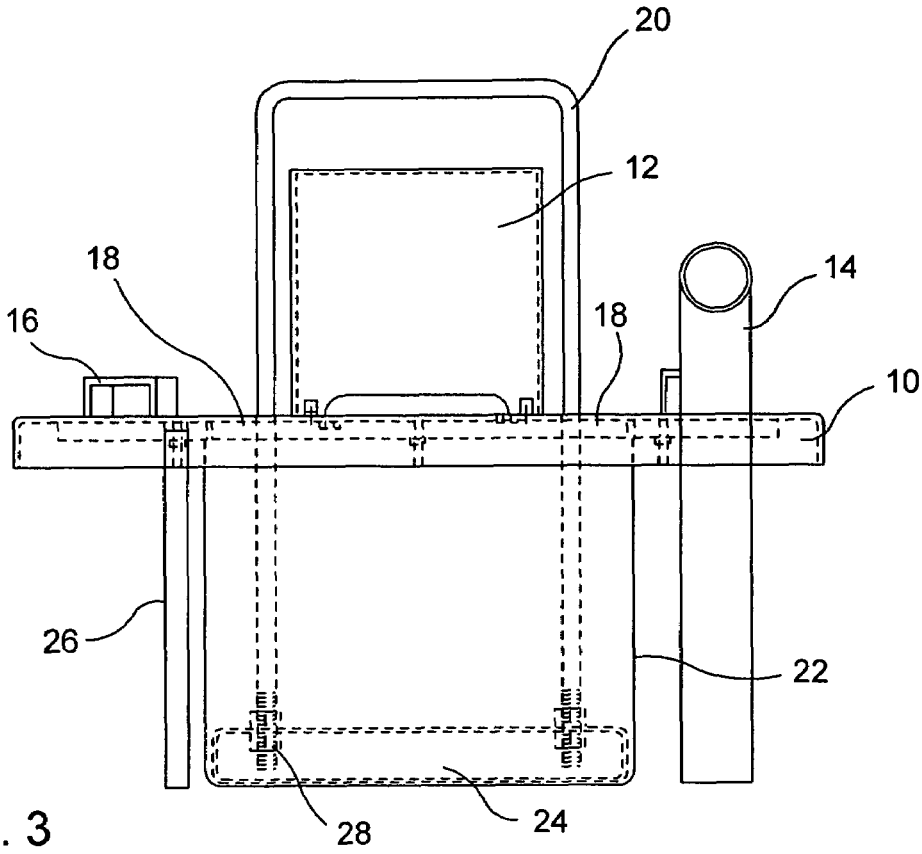
FIG. 3 is a side view of the lid of the drum-style vacuum cleaner with shaker handle.
Figure 4:
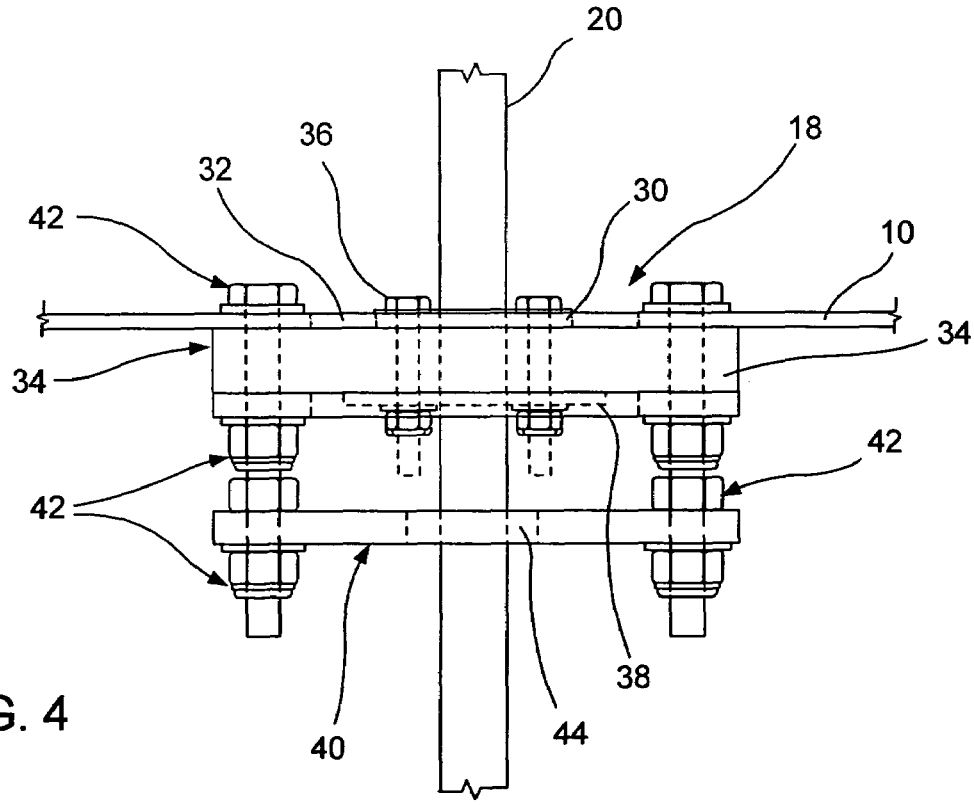
FIG. 4 shows an embodiment of a through hole for the shaker handle through the lid.

FIG. 2 shows the lid of the drum-style vacuum cleaner. Here, the shaker handle 20 is U-shaped, having two arms 21 and 23, extending across the top-mounted vacuum motors, the two open ends of the handle 20 protrude through two through-holes 18 formed in the lid 10. The through-holes are elastically deformable to accommodate the back and forth movement of arms 21 and 23 of the handle 20, without compromising the vacuum pressure in the drum. The arrangement of the filter bag below the lid, covering a vacuum air port is known. The filter bag 22 is held in place by a cage or an arm 26 (FIG. 3), which is affixed to the bottom of the lid 10. The open top of the filter bag 22 is pressed against a seal in the lid 10 and covers an air exhaust vacuum port. The filter bag 22 is easily removable or exchangeable. After extending through the elastic through hole 18, the shaker handle 20 is guided through a slot 44 in a guide template 40 (FIG. 4), which controls the extent of the movement of the shaker handle 20 and frame 24 inside the filter bag 22. FIG. 4 also shows that the elastically deformable seal 18 includes a rubber seal 34, positioned and clamped under the drum lid 10 by nuts and bolts 42. The handle 20 extends through an opening in the rubber seal and is held in position by a washer 30 welded to the handle, positioned above the lid 10 and a counter plate 38, positioned below the lid 10. The guide template 40 is held in place but the nuts and bolts arrangement 42 which also holds the rubber seal 34.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A manually moveable filter shaker for a drum shaped vacuum cleaner comprising (a) a drum lid;

(b) a filter bag mounted below the drum lid;

(c) a filter shaker including a shaker handle having two arms and being operable from outside of the drum lid and the two arms extending through elastically deformable pressure-tight through holes in the drum lid and into the filter bag having a bottom, the arms of the shaker handle terminate in a shaker frame designed to conform to a contour of the bottom of the filter bag; and (d) at least one guide template mounted to the drum lid and defining the manual movement of the shaker handle such that the handle moves the filter bag with the movement of the handle.

2. The manually moveable filter shaker according to claim 1, wherein the handle is generally U-shaped and wherein two elastically deformable pressure-tight through-holes are disposed in the drum lid and each arm extends through the through-hole.

3. The manually moveable filter shaker according to claim 2, wherein the at least one guide template comprises two guide templates, each controlling the manual movement of the respective arm of the shaker handle.

4. The manually moveable filter shaker according to claim 3, wherein the two guide templates each include a slot through which the arms of the shaker handle are guided and wherein the slots define the extent of movement the arms may be moved.

5. The manually moveable filter shaker according to claim 4, wherein the guide template is elastically mounted to the drum lid.

6. The manually moveable filter shaker according to claim 2, wherein the shaker frame is a rectangular frame made from metal rod material.

7. The manually moveable filter shaker according to claim 2, wherein the shaker frame includes a cross member which is connected to the arms of the shaker handle.

8. The manually moveable filter shaker according to claim 7, wherein the arms of the shaker handle terminate in a threaded portion.

9. The manually moveable filter shaker according to claim 8, wherein the threaded portion of the arms extend through the cross member of the frame and are held in a desired position by nuts.

10. The manually moveable filter shaker according to claim 9, wherein the desired position of the frame may be altered for accommodate varying filter sizes.

* * * * *